United States Patent [19]

Tokarz

[11] 3,949,475

[45] Apr. 13, 1976

[54] CHAIN SAW GUIDE BAR

[75] Inventor: Joseph Tokarz, Byram, Conn.

[73] Assignee: Textron, Inc., Providence, R.I.

[22] Filed: Mar. 18, 1975

[21] Appl. No.: 559,639

[52] U.S. Cl. ..... 30/387; 52/615

[51] Int. Cl.[2] ..... B27B 17/04

[58] Field of Search ..... 30/381, 382, 383, 384, 30/387, 385; 83/820, 821, 824; 29/509, 512, 463; 113/116 FF; 52/615

[56] References Cited

UNITED STATES PATENTS

| | | | |
|---|---|---|---|
| 2,660,204 | 11/1953 | Rosenboom | 30/387 |
| 2,838,833 | 6/1958 | Richardson | 29/463 |
| 2,962,061 | 11/1960 | Nielsen | 30/387 X |
| 3,276,112 | 10/1966 | Tantlinger | 29/243.52 X |
| 3,685,623 | 8/1972 | Bradshaw | 29/509 |

FOREIGN PATENTS OR APPLICATIONS

| | | | |
|---|---|---|---|
| 1,378,471 | 10/1964 | France | 30/381 |

*Primary Examiner*—Al Lawrence Smith
*Assistant Examiner*—J. C. Peters
*Attorney, Agent, or Firm*—Robert E. Burns; Emmanuel J. Lobato; Bruce L. Adams

[57] ABSTRACT

A chain saw guide bar is formed of two metal plates of uniform thickness and of like size and shape. Each of the plates has local areas displaced from the plane of the plate to form protuberances on the inner face of the plate and corresponding recesses in the outer face. The protuberances are spaced from one another both laterally and longitudinally of the plate and comprise rows of protuberances which are spaced inwardly from opposite side edges of the plates a distance slightly greater than the length of the tangs of a saw chain to be used on the guide bar. The two plates are superposed on one another with the protuberances of one plate engaging matching protuberances of the other plate. One of the protuberances of each pair of matching protuberances has an integral tubular projection extending through a hole in the matching protuberance and riveted over in the corresponding recess to unite the plates in a unitary structure. The plates thus united are spaced apart from one another by the protuberances except in the local areas of the protuberances. The spacing of at least the peripheral portions of the plates outside the rows of protuberances is slightly greater than the thickness of the tangs of the saw chain so as to accommodate the tangs between the peripheral portions of the plate with working clearance. The riveting of all of the projections is preferably effected simultaneously.

6 Claims, 4 Drawing Figures

CHAIN SAW GUIDE BAR

FIELD OF INVENTION

The present invention relates to chain saw guide bars and to an improved method for making such guide bars.

BACKGROUND OF THE INVENTION

The cutting chain of a chain saw customarily runs on a guide bar which is affixed to and projects from the powerhead by which the chain is driven. The guide bar is usually "beaver-tail" shaped and is provided with a peripheral groove for retaining and guiding the cutting chain. The chain customarily has side links, the lower edges of which rest on the peripheral edge of the guide bar on opposite sides of the groove and center links having tangs which project beyond the lower edges of the side links and extend into the peripheral groove of the guide bar.

Guide bars may be of either solid or laminated construction. A solid guide bar is formed of a single steel plate, the peripheral edge of which is machined to provide a peripheral groove and chain-supporting edges on opposite sides of the groove. A laminated guide bar may be formed of three steel plates, the combined thickness of which is equal to the thickness of the desired guide bar. The two outer plates are of like size and shape while the middle plate which is sandwiched between the two outer plates is of similar shape but of smaller size so that when the plates are assembled the peripheral edge of the center plate is spaced inwardly from the peripheral edges of the two outer plates so as to provide a peripheral groove. The assembled plates are suitably united with one another for example by riveting. It is also known to make a laminated guide bar with only two plates which are spaced from one another by suitable spacers disposed between the plates. Alternatively, peripheral edge portions of the plates may be offset outwardly from the plane of the plate so as to provide a peripheral groove in the guide bar when the plates are assembled.

SUMMARY OF INVENTION

It is an object of the present invention to provide a chain saw guide bar which is lightweight and yet strong and durable and resistent to bending during use. Moreover, the guide bar in accordance with the present invention is economical to manufacture by reason of savings in material and savings in the cost of fabrication.

In accordance with the present invention the guide bar is made of only two elongate metal plates of uniform thickness and of like size and shape. Each of the plates has local areas displaced from the plane of the plate to form protuberances on the inner face of the plate and corresponding depressions or recesses in the outer face of the plate. The protuberances are spaced from one another both laterally and longitudinally of the plate and comprise rows of protuberances which are spaced inwardly from opposite lateral edges of the plates a distance slightly greater than the length of the tangs of the chain with which the guide bar is to be used. The two plates are superposed on one another with the protuberances of one plate engaging matching protuberances of the other plate. One of the protuberances of each pair of matching protuberances has an integral tubular projection which extends through a hole in the matching protuberance and is riveted over in the corresponding recess to unite the plates into a unitary structure. The plates are spaced apart from one another by the protuberances except in the local areas of the protuberances. The spacing of at least the peripheral portions of the plates outside the rows of protuberances is slightly greater than the thickness of the tangs of the saw chain so as to accommodate the tangs between the peripheral portions of the plate with working clearance. For example if the tangs have a thickness of 0.050 inch the space between the peripheral portions of the plates is of the order of 0.055 to 0.060 inch.

The two plates comprising the guide bar are readily made from suitable sheet or strip steel stock, the protuberances and the projections as well as the holes for receiving the projections being readily formed by a stamping or die forming operation. It is preferable to use high carbon steel stock so that edge portions of the plates can be hardened by heat treatment after the plates are formed and thereby rendered more resistent to wear by the chain. The two plates are preferably identical with one another so that both can be produced with one set of dies. Half of the protuberances are provided with projections and the other half are provided with corresponding holes, the holes and projections being arranged symmetrically with respect to the longitudinal center line of the plates so that when one plate is inverted and superposed on the other plate the projections on one plate are received in holes in the other plate. Preferably all of the projections are riveted simultaneously while the plates are held in a suitable die or fixture which keeps them straight and flat.

BRIEF DESCRIPTION OF DRAWINGS

The nature, objects and advantages of the invention will appear more fully from the following description of guide bars made in accordance with the invention and illustrated by way of example in the accompanying drawings in which.

Figure 1:
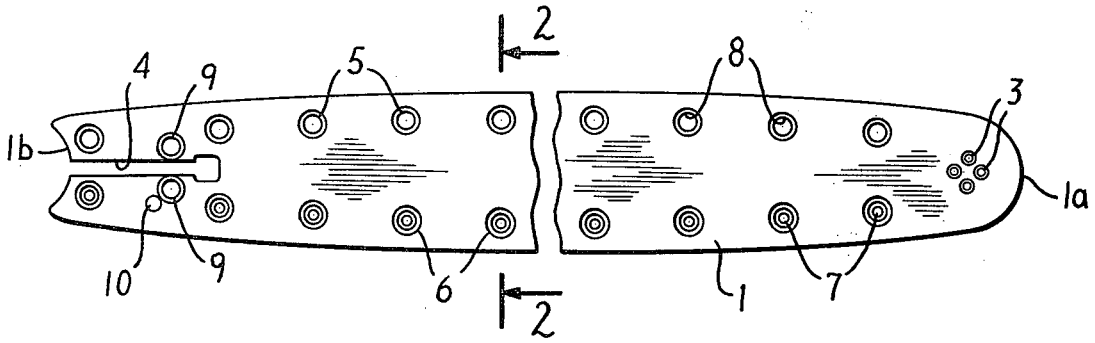
FIG. 1 shows the inner face of one of a pair of like metal plates of which a guide bar in accordance with the invention is to be made.

DESCRIPTION OF PREFERRED EMBODIMENT:

The chain saw guide bar as illustrated by way of example in the drawings comprises two thin plates 1 and 2 of identical size, shape and configuration. The plates are preferably formed of high carbon steel to permit subsequent hardening by suitable heat treatment. As seen in FIG. 1 the plates are of "beaver-tail" shape with a rounded nose 1a and approximately parallel but somewhat convex sides. The nose portions of the plates are shown provided with suitable holes 3 for mounting a nose sprocket or roller between the plates. The inner ends of the plates are concave as indicated at 1b to accommodate a sprocket by which the chain is driven and a longitudinally extending slot 4 is provided for adjustably mounting the guide bar on the powerhead of a chain saw by means of bolts passing through the slot 4. While guide bars are of different sizes depending on the size and intended purpose of the chain saw on which they are used, the bar shown by way of example in the drawings has a length of approximately 15 inches and a width of approximately 2.5 inches.

In order to space the two plates apart when they are assembled to form a guide bar and thereby provide a peripheral groove for receiving the tangs of a cutting chain running on the guide bar, local areas of each of the plates are displaced from the plane of the plate to form a plurality of bosses or protuberances 5 on the inner face of the plate and corresponding depressions or recesses 6 on the outer face. While the protuberances 5 can be of any desired shape, they are preferably at least approximately circular as illustrated in FIG. 1. The protuberances are spaced from one another both laterally and longitudinally of the plate and occupy only a small portion of the total area of the plate. Thus, the aggregate area of all of the protuberances is less than 20 percent and preferably less than 10 percent of the area of the plate. It will further be noted that the protuberances are spaced apart from one another a distance considerably greater than the diameters of the protuberances. By way of example with a guide bar of the size noted above, the protuberances have a diameter of about 0.5 inch and are spaced apart from one another a distance which varies but is approximately 1.5 inches.

As seen in FIG. 1 the protuberances 5 are arranged in two rows which are spaced inwardly from opposite side edges of the plate. The rows of protuberances are arranged as close to the periphery of the plate as possible while providing clearance for passage of the tangs of a saw chain running on the completed bar. Thus, the protuberances are spaced from the periphery of the plate a distance greater than the length of the tangs and preferably not greater than twice the length of the tangs of the saw chain. In addition to the protuberances located adjacent the periphery of the plate, other protuberances may if desired be provided in central areas of the plate. This may be desirable for example in larger guide bars.

The protuberances on each of the plates are so arranged that when the plates are assembled face to face the protuberances on one plate engage matching protuberances on the other plate. The two plates are thus spaced apart from one another except in the areas of the protuberances by the matching pairs of protuberances. The plates thus assembled are joined together into a unitary structure by projections on protuberances of one plate extending through holes in the matching protuberances of the other plate. The ends of the projections are clinched or riveted over in the corresponding recesses in the outer face of the plate so as to secure the two plates together. While all of the projections could if desired be provided on one of the plates, it is considered preferable to make the two plates identical in which event half of the protuberances of each plate are provided with projections and the other half are provided with holes. The projections and holes are so arranged that when the two plates are brought together face to face the projections on one plate register with the holes of the other plate.

As shown by way of example in the drawings integral tubular projections 7 are provided on half of the protuberances 5. The projections are smaller than the protuberances so as to leave a flat surface 5a around each projection. For example if the diameter of a protuberance is 0.5 inch the outside diameter of the tubular projections 7 is about 0.25 inch. The height of the projections is sufficient for the projections to extend through the other plate of the guide bar and be clinched or riveted over so as to secure the plates together. The other protuberances 5 are provided with holes 8 of a size to receive the tubular projections 7. For example if the projections 7 have an outside diameter of 0.25 inch the holes 8 suitably have a diameter of 0.26 inch. The protuberances having projections and those having holes are arranged symmetrically with respect to the longitudinal center line of the guide bar so that when one of the plates is inverted and superposed on the other the projections on one plate register with the holes of the other. As shown by way of example in FIG. 1 the protuberances 5 on one side of the longitudinal center line of the plate are provided with projections while the protuberances on the other side of the center line are provided with holes. The matching of a protuberance having a projection with a protuberance having a hole can of course be obtained by other arrangements. For example, projections can be provided on odd numbered protuberances on one side of the center line of the plate and on even numbered protuberances on the other side of the center line, the remaining protuberances being provided with holes. The holes 8 are sufficiently smaller than the protuberances to leave a flat surface *5a* around the hole which engages a corresponding surface of the matching protuberance to space the plates precisely from one another when they are assembled and are united by the riveting of the projections.

In addition to the protuberances 5, the plates are provided with flat topped protuberances 9 which are located on opposite sides of the slot 4. As the bolts for securing the guide bar to the powerhead of a chain saw pass through the slot 4 and tend to pull the plates together, the function of the protuberances 9 is merely to reinforce the plates and hold them in spaced relationship. Hence, these protuberances are not provided with projections or holes.

The protuberances 5 and 9 and the projections 7 are readily formed in the plates by a stamping or die forming operation. By using suitable dies it is possible to stamp the plates from sheet or strip stock and form the protuberances and projections in one operation. At the same time it is possible to form the holes 3 and 8 and any additional holes that may be desired, for example a hole 10 provided for lubrication of the chain. As the two plates from which the guide bar is formed are identical with one another they can be produced with the same set of dies.

Figure 2:
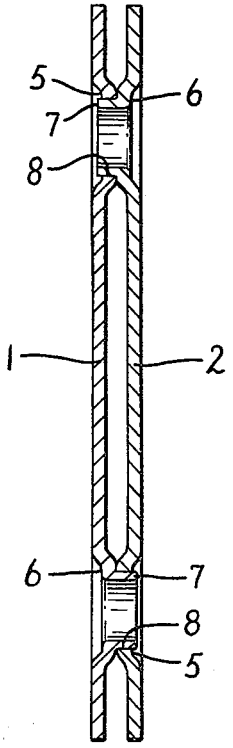
FIG. 2 is an enlarged cross section of the two plates superposed on one another but before riveting of the projections the section being taken in the location indicated by the line 2—2 in FIG. 1.
Figure 2A:
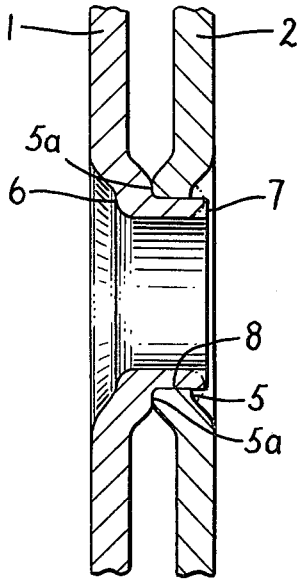
FIG. 2*a* is an enlarged cross sectional view of a matching pair of protuberances.
Figure 3:
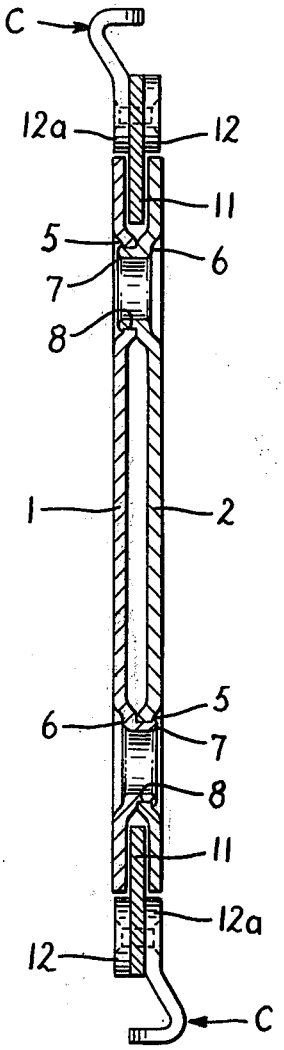
FIG. 3 is a cross section corresponding to FIG. 2 but after the two plates have been united by riveting the plates together to form a completed guide bar on which portions of a cutting chain have been shown schematically.

The two plates which are to form a guide bar are assembled in superposed position as illustrated in FIG. 2 with matching protuberances engaging one another and with the projection 7 of one protuberance of a pair extending through the hole 8 in the matching protuberance. The engagement of the projection 7 in the holes 8 holds the two plates in proper registry with one another. The ends of the projections 7 are then clinched or riveted over as illustrated in FIG. 3 to unite the two plates into a unitary structure. The riveting is effected by suitable dies or tools while the assembled plates are held flat and straight, for example by a suitable fixture. Preferably all of the projections are riveted simultaneously. This speeds production and contributes to the trueness and flatness of the completed bar.

When the two plates 1 and 2 have been united to form a guide bar as illustrated in FIG. 3, the plates are spaced apart except in the areas of the protuberances. The spacing is precisely determined by the height of the flat topped protuberances 5 so that the tangs 11 of a saw chain C are received with proper working clearance between peripheral portions of the plates 1 and 2 while the lower edges of side links 12 and 12*a* of the chain slide on and are supported by peripheral edges of the plates. By having the protuberances and hence the riveted projections as close to the edges of the guide bar as possible while permitting passage of the tangs of the saw chain, any separating forces exerted by the chain on the plates of the guide bar are effectively resisted. Moreover, since the plates forming the guide bar are spaced apart in central areas as well as adjacent the periphery, the stiffness of the guide bar is increased so as to resist bending forces. After formation of the plates and preferably before they are united peripheral portions of the plates are heat treated so as to harden them and thereby make them more resistant to wear by the chain.

It will be noted that the riveting of the projections 7 occurs within the recesses 6 provided in the outer face of the plates by formation of the protuberances 5. Hence, the riveted ends of the projections 7 are recessed and do not project beyond the plane of the outer face of the guide bar. The guide bar is thereby provided with smooth and unobstructed side faces without the need of countersinking the holes 8.

From the foregoing description and the accompanying drawings it will be seen that in accordance with the present invention a guide bar which is strong, durable and yet lightweight can be produced rapidly and economically. While a preferred embodiment of the invention has been illustrated by way of example in the drawings and is herein particularly described, it will be understood that modifications may be made while still retaining advantages of the invention. For example with larger guide bars it may be desirable to provide spacing protuberances in central portions of the guide bar as well as along opposite edge portions. Still other modifications will be apparent to those skilled in the art.

What I claim and desire to secure by letters patent is:

1. A chain saw guide bar for supporting and guiding a cutting chain having supporting edges and tangs of selected thickness projecting a selected length beyond said supporting edges, said guide bar comprising two elongate sheet metal plates of uniform thickness and of like size and shape, each of said plates having an inner face and an outer face and having local areas displaced from the plane of the plate to form protuberances on the inner face of the plate and corresponding recesses in the outer face of the plate, said protuberances being spaced from one another both laterally and longitudinally of the plate and comprising rows of protuberances which are spaced inwardly from opposite lateral edges of the plate a distance greater than the length of said tangs of the chain and less than twice the length of the tangs, said plates being superposed on one another with said protuberances of one plate engaging matching protuberances of the other plate, one of the protuberances of a pair of matching protuberances having an integral tubular projection extending through a hole in the matching protuberance and riveted over in the corresponding recess to unite said plates in a unitary structure, said plates being spaced apart from one another by said protuberances except in the local areas of the protuberances, the spacing of at least the peripheral portions of the plates outside said rows of protuberances being slightly greater than the thickness of said tangs to accommodate said tangs between said peripheral portions of the plate with working clearance.

2. A chain saw guide bar according to claim 1, in which said two plates are alike and in which half of said protuberances on each plate have said holes and the other half of said protuberances have said projections, said holes and projections being so arranged that when one of said plates is inverted and placed on the other, the projections on one plate fit into the holes of the other plate.

3. A chain saw guide bar according to claim 2, in which the protuberances on one side of the longitudinal center line of the plate have holes and the protuberances on the other side of the longitudinal center line of the plate have projections.

4. A chain saw guide bar according to claim 1, in which said protuberances occupy less than 20 percent of the area of the guide bar.

5. A chain saw guide bar according to claim 4, in which said protuberances occupy less than 10 percent of the area of the guide bar.

6. A chain saw guide bar according to claim 1, in which said protuberances are at least approximately circular and in which the distance between protuberances is greater than the diameter of said protuberances.

* * * * *